United States Patent [19]

Desimone

[11] Patent Number: 4,879,781

[45] Date of Patent: Nov. 14, 1989

[54] TOOTHBRUSH WITH POSITIONABLE STIMULATOR TIP

[75] Inventor: Joseph A. Desimone, Bricktown, N.J.

[73] Assignee: Johnson & Johnson Consumer Products, Inc., New Brunswick, N.J.

[21] Appl. No.: 234,247

[22] Filed: Aug. 19, 1988

[51] Int. Cl.[4] ..... A61H 13/00

[52] U.S. Cl. ..... 15/110; 128/62 A; 403/93

[58] Field of Search ..... 15/110; 128/62 R, 62 A; 132/321, 328, 329; 403/92, 93, 95, 96

[56] References Cited

U.S. PATENT DOCUMENTS

| | | | |
|---|---|---|---|
| 2,790,441 | 4/1957 | Oderman | 128/62 A |
| 2,800,899 | 7/1957 | Barron | 15/167.1 X |
| 2,888,008 | 5/1959 | Rosenthal | 15/110 X |
| 4,296,518 | 10/1981 | Furrier et al. | 15/110 |

*Primary Examiner*—Peter Feldman
*Attorney, Agent, or Firm*—Joseph F. Shirtz

[57] ABSTRACT

Improved attachment structure between a rotatable interdental device and a toothbrush handle having said device rotatable about a movable shaft. The device is held in position by positioners which engage when the device is at a predetermined angle to said handle and said shaft is in a first position. The positioners dissengage when the shaft moves to a second position. The positioners interact in a camming manner so that a predetermined force cams the shaft into its second position. The shaft extends from a resilient cantilever arm which biases the shaft toward the first position. The shaft also includes diverging wedgelike end surfaces which facilitate separating legs of the device for assembly of the shaft and device.

16 Claims, 2 Drawing Sheets

1
2
3
4
5
10

5
6
7
8
9
10
11
12
13
14
15
16
17
18
19
20
21
22
23
24
27
28

TOOTHBRUSH WITH POSITIONABLE STIMULATOR TIP

FIELD OF THE INVENTION

This invention relates to apparatus for dental hygiene and in particular to a toothbrush handle having a rotatably attached stimulator tip.

BACKGROUND OF THE INVENTION

It is well known in the art to provide an apparatus for gum stimulation on the handle of a toothbrush. The known tips have used several techniques for providing a rotating or directionally controllable stimulator tip.

U.S. Pat. No. 2,790,441 discloses an interdental massage device which is attached to a toothbrush handle. The device is rotatable on a pin and is held in place by co-fitting faces on the brush handle and the device. The device is movable between positions perpendicular to the handle, for use, and coaxial with the handle, for storage.

U.S. Pat. No. 2,800,899 discloses a swivel mounted gum massage device. The device has a fixed hinge pin and is held in position by a combination of interfering surfaces and the interaction of projections and recesses which are appropriately positioned.

U.S. Pat. No. 2,888,008 discloses a dental massage device having a leaf spring which maintains the device's position. The massage device has a box-like portion at the rear of its body. The leaf spring lies on one surface of the box. In order to swivel the massage device the corner formed by two surfaces of the box must flex the leaf spring thus flexing the spring outward. Once the corner passes the leaf spring returns to its original position and holds the massage device by applying pressure to the next surface now adjacent the spring.

U.S. Pat. No. 4,296,518 discloses a gum massaging accessory for a toothbrush. The accessory is either hingeably attached with a fixed pin or has a spherical end which is received within a socket formed in the end of a toothbrush.

None of the above described disclosures shows a two piece unit which provides for multi-positions of a toothbrush attachment such as a gum stimulator. In each case either the axis of rotation is fixed, there is only a limited number of positions or the device requires multiple parts.

SUMMARY OF THE INVENTION

The invention provides a novel means of attaching a stimulator tip to a toothbrush handle. The novel means permits fabrication of the stimulator tip and brush handle separately for quick attachment. Once attached the position of the body of the stimulator flexes resiliently to permit disengagement of cooperating locators on the handle and stimulator tip body.

The novel structure of the invention is provided by an integral resilient, shaft on the handle which receives the stimulator body for pivotal mounting. The shaft may be provided on a perpendicular cantilever shaft thus providing resilient motion in response to flexing of the cantilever.

The cooperating locators may take the form of interacting points and detents. Preferably the stimulator body has detents on a rear arcuate surface which has its center of curvature at the same point as the resilient axis and the point is provided on the handle. In the locked position a detent is biased onto the point by the resilient axis. Rotation of the stimulator forces the stimulator away from the pointer to permit the pointer to clear the detent. This action forces the axis to flex away from the point by the camming effect of the pointer on the sides of the detent. The resilient characteristics of the axis define the force necessary to disengage the point and detent and therefor define the force necessary to move the stimulator between positions.

BRIEF DESCRIPTION OF THE DRAWING

The invention will now be described in greater detail with reference to the drawings wherein.

DESCRIPTION OF THE PREFERRED EMBODIMENT

Figure 1:
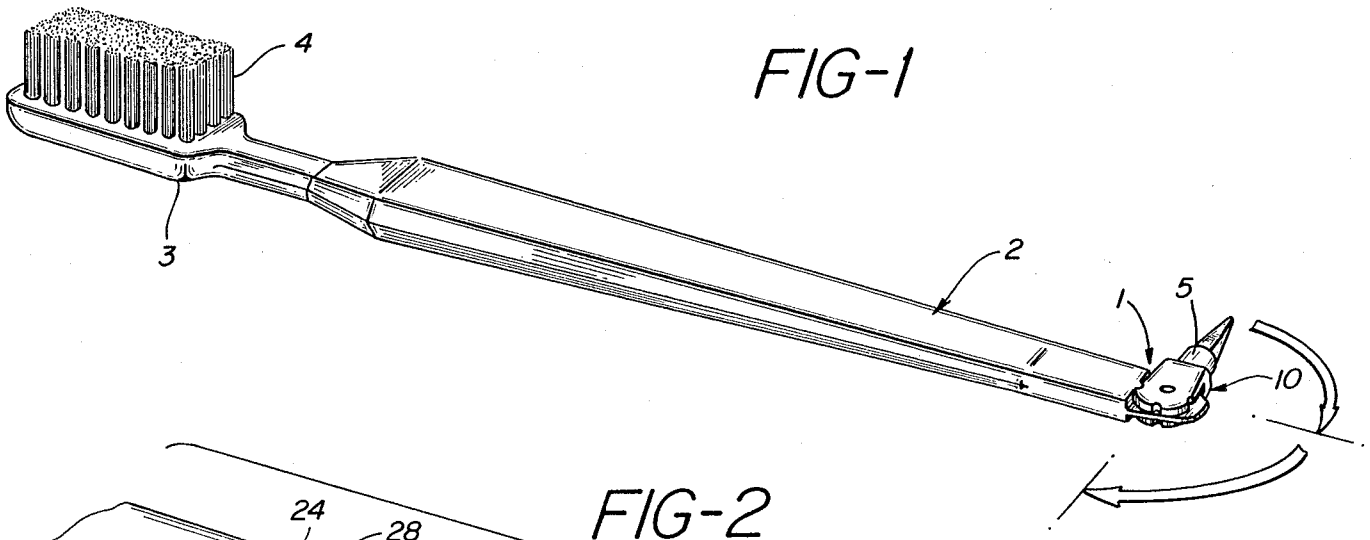
FIG. 1 is a perspective view of a toothbrush and stimulator tip.

Referring now to FIG. 1, a toothbrush having a rotating stimulator tip is shown. The tip 1 rotates in a plane including a handle 2. The tip rotates slightly more than 180° between positions approximately perpendicular to and on opposite sides of handle 2. Handle 2 includes brush head 3 having groups 4 of bristles. This brush head 3 may take any of the many forms known in the art and may be coaxial with or angled to handle 2.

Figure 2:
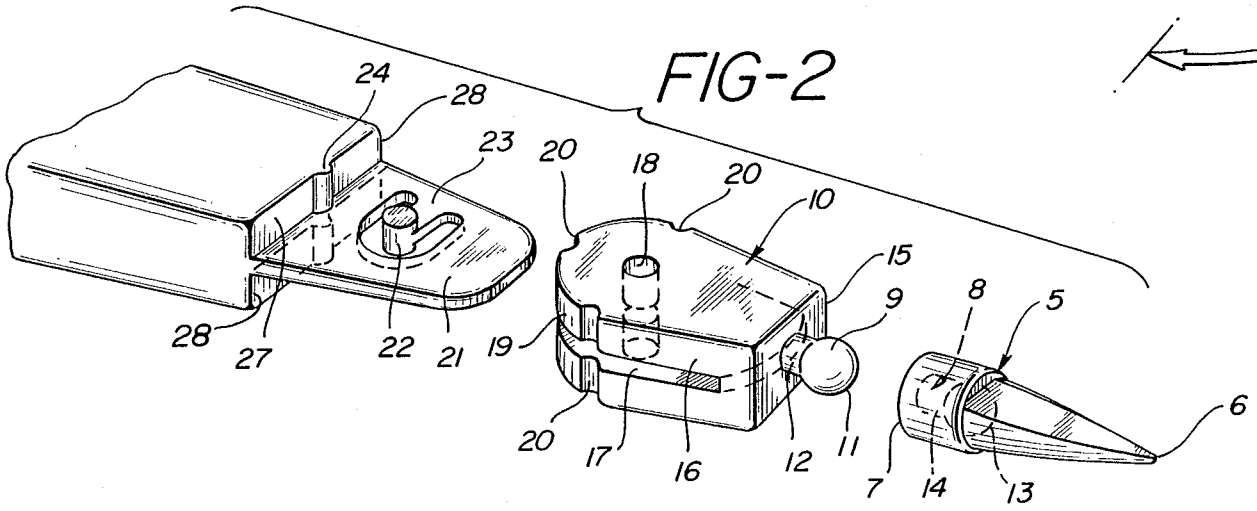
FIG. 2 is an enlarged exploded view of the stimulator tip.
Figure 3:
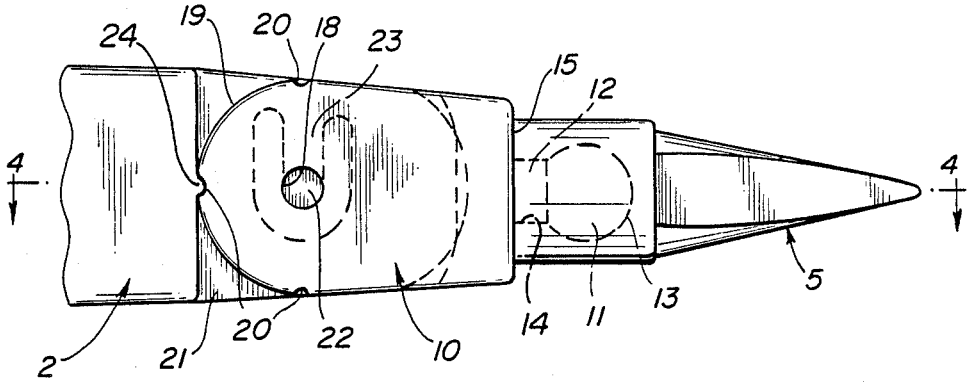
FIG. 3 is a plan view showing the stimulator in greater detail.
Figure 4:
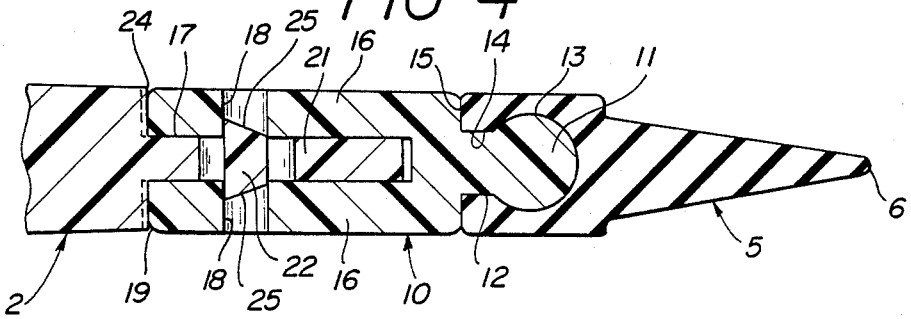
FIG. 4 is a cross-sectional view along line 4—4 of FIG. 3.

FIG. 2 shows the structure of tip 1. Stimulator 5 has a conical shape which terminates at a stimulation end 6. At its other end stimulator 5 terminates in an abutting end 7. A socket 8 is defined by the stimulator 5 and opens through abutting end 7. Socket 8 receives a mounting stub 9 which extends from body 10. Stub 9 has a spherical end portion 11 and a connecting neck 12 which is cylindrical and has a diameter smaller than spherical end portion 11.

In order to facilitate a strong attachment between stimulator 5 and body 10 the socket 8 is formed with a shape complimentary to stub 9. Therefore, socket 8 has a spherical space 13 communicating with a cylindrical space 14 which opens through the abutting end 7. Cylindrical space 14 is defined by the stimulator 5 with a smaller diameter than spherical space 13. Thus when stub 9 is received within socket 8, the smaller diameter of cylindrical space 14 resists movement of spherical end portion 11 through the cylindrical space. If stimulator 5 is made of a resilient elastomeric material, then cylindrical space 14 may be made longer than neck 12. Thus when spherical end portion 11 is received within spherical space 13 the stimulator 5 abuts surface 15 as is slightly compressed between surface 15 and spherical end portion 11. The stimulator is thereby fixed in position and slack in the stub-socket connection is removed.

Body 10 has a pair of legs 16 extending in parallel spaced relation to one another. The legs 16 thereby define a slot 17 there-between which is coplanar with the plane of rotation of stimulator tip 1. Each leg defines a bearing 18 which communicates with slot 17. Each bearing 18 has its axis perpendicular to slot 17 and is aligned with the bearing defined by the other leg.

At the end of body 10 opposite surface 15 is an arcuately shaped positioning surface 19. The arcuate shape of positioning surface 19 has its axis of curvature at the axis of the bearing 18. Detents 20 are formed in the positioning surface 19. The detents 20 extend parallel to the axis of curvature of the positioning surface and open radially outward of positioning surface 19.

At the end of handle 2 opposite the brush head is an extending tab 21. Tab 21 is sized and shaped to be received within slot 17. Resiliently attached to tab 21 is shaft 22. Preferably tab 21 and shaft 22 are formed of the same material as handle 2 thereby permitting integral forming of the shaft 22 and tab 21. The shaft 22 is resiliently mounted to arm 23 which extends into an opening of tab 21. Arm 23 acts as a resilient cantilever for mounting shaft 22 perpendicular to tab 21. Shaft 22 has a diameter which permits it to be received within bearings 18.

At the base of tab 21 adjacent handle 2 is positioning cam 24. Cam 24 extends parallel to and at a predetermined distance from unflexed shaft 22. The distance between unflexed shaft 22 and cam 24 is less than the distance from the center of bearing 18 to positioning surface 19.

The stimulator is assembled by elastically stretching cylindrical space 14 over the spherical end portion 11 so stub 9 is received in socket 8. Tab 21 is received within slot 17. During insertion of tab 21 into slot 17 diverging ends 25 of shaft 22 act to wedge apart legs 16 until shaft 22 is received within bearing 18. The body 10 with stimulator 5 is now rotatably mounted on handle 2. Because the distance from the center of bearings 18 to arcuate positioning surface 19 is greater than the distance from the center of shaft 22 (then unflexed) to cam 24, the shaft 22 is pushed away from cam 24 when the cam moves along positioning surface 19. Thus the body 10 is biased radially toward cam 24. When the body 24 is rotated to a position providing alignment of cam 24 and a detent 20, the cam 24 is received within detent 20 holding the body in that position. When the detent 20 receives cam 24 the body moves radially toward the cam thus slightly unflexing the cantilever of shaft 22. In order to move the position of body 10, sufficient torque must be applied to the body to permit cam 24 to slide up one side of detent 20 biasing the body away from cam 24. This biasing causes greater flex in the resilient mounting of shaft 22. Thus the force required to rotate body 10 is a function of the shapes of cam 24 and detent 20 and the resilient force of mounting shaft 22.

Figure 5:
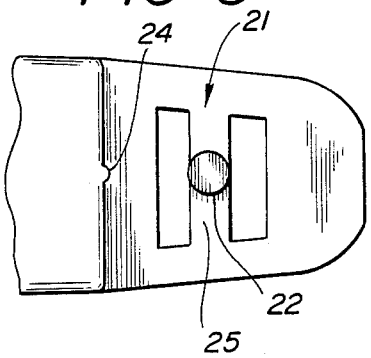
FIG. 5 is an alternate embodiment of the invention.

An alternative embodiment of tab 21 is shown in FIG. 5. Rather than cantilever mounting of shaft 22, a bridge mount 25 is provided. By providing a bridge 25 a force in excess of twice the amount necessary to bias the cantilever is necessary to bias the bridge an equal distance.

Detents 20 may be provided at any location along positiong surface 19. Preferably three detents are provided. One detent is positioned so as to align the stimulator and handle 2 in a coaxial manner. This position permits placing the toothbrush into the opening of a toothbrush holder without interference of the stimulator. The other two preferred positions for the detents locate the stimulator at right angles to the handle on opposite sides of the handle.

In order to reinforce the position of the stimulator when in a position perpendicular to the handle, handle end 27 is shaped so corners 28 interfere with further rotation of the stimulator. Thus, rotation of the stimulator is arrested in one direction even if the forces of using the stimulator exceed that necessary to disengage the cam 24 and detent 20.

A further embodiment provides parallel flats 26 on the stimulator 5, thus a narrower width is provided in one cross-sectional direction at the tip versus a direction perpendicular thereto.

What is claimed is:

1. In a toothbrush having a handle and an interdental device rotatably attached to said handle, the improvement wherein:

(a) said device is mounted for rotation about an axis which is movable between a first position and a second position; and (b) positioning means are provided which hold said device in a predetermined orientation when said axis is in said first position and permits movement of said device when said axis is in said second position.

2. The improvement according to claim 1 wherein:

(a) said axis is biased into said first position.

3. The improvement according to claim 2 wherein:

(a) said positioning means comprises:

(i) at least one detent on one of said handle and said device; and (ii) at least one interfitting surface on the other of said handle and said device which interfits with said detent to hold said device when said device is in said predetermined position and said axis is in said first position.

4. The improvement according to claim 3 wherein:

(a) there are a plurality of detents.

5. The improvement according to claim 3 wherein:

(a) there are a plurality of said interfitting surfaces.

6. The improvement according to claim 2 including:

(a) a shaft coaxial with said axis on one of said handle and said device resiliently positioned in said first position; and, (b) a bearing means on the other of said handle and said device for operating with said shaft to rotatably mount said device to said handle.

7. The improvement according to claim 6 wherein:

(a) said shaft is resiliently mounted to said handle; and (b) said bearing means is on said device.

8. The improvement according to claim 6 wherein:

(a) said shaft is attached by a cantilever arm which resiliently flexes between said first and second positions to bias said shaft into the first position of said axis.

9. The improvement according to claim 8 wherein:

(a) said shaft, said arm and said one of said handle and said device are integrally formed.

10. The improvement according to claim 2 including:

(a) a tab which is received by said device extending from said handle and parallel to a plane of rotation of said device; and (b) a shaft movably connected to said tab about which said device rotates.

11. The improvement according to claim 10 including:

(a) at least one bearing defined by said device which receives said shaft to mount said device rotatably to said handle.

12. The improvement according to claim 11 wherein:

(a) said device includes two parallel spaced legs and said tab is received between said legs.

13. The improvement according to claim 12 including:

(a) a cantilevered arm extending from said tab and connecting said shaft to said tab.

14. The improvement according to claim 13 wherein:

(a) said arm is resilient and biases the shaft so said axis is biased into said first position.

15. The improvement according to claim 12 including:

(a) diverging end surface on said shaft adapted to wedge said two parallel spaced legs apart until said shaft is received by said bearing.

16. The improvement according to claim 10 wherein:

(a) said tab defines an opening having a resilient cross-bar extending thereacross and said shaft extends from said cross-bar.

* * * * *

UNITED STATES PATENT AND TRADEMARK OFFICE

CERTIFICATE OF CORRECTION

PATENT NO. : 4,879,781

DATED : November 14, 1989

INVENTOR(S) : Joseph A. Desimone

It is certified that error appears in the above-identified patent and that said Letters Patent is hereby corrected as shown below:

In Column 4, line 40 (Claim 6):

"operating" should be --cooperating--.

Signed and Sealed this

Second Day of July, 1991

*Attest:*

HARRY F. MANBECK, JR.

*Attesting Officer*

*Commissioner of Patents and Trademarks*